US007731455B2

(12) United States Patent
Shin

(10) Patent No.: US 7,731,455 B2
(45) Date of Patent: Jun. 8, 2010

(54) SEGMENTAL RETAINING WALL SYSTEM INCORPORATING THE EXTRUDED POLYMER STRIP AS A REINFORCEMENT

(75) Inventor: Hye Seoung Shin, Yonggin-Si (KR)

(73) Assignee: Sung Min Hong, London, Ontario (CA)

( * ) Notice: Subject to any disclaimer, the term of this patent is extended or adjusted under 35 U.S.C. 154(b) by 0 days.

(21) Appl. No.: 12/153,625

(22) Filed: May 22, 2008

(65) Prior Publication Data

US 2008/0289283 A1 Nov. 27, 2008

(30) Foreign Application Priority Data

May 22, 2007 (KR) ..... 10-2007-0049628

(51) Int. Cl.
*E02D 29/02* (2006.01)

(52) U.S. Cl. ..... 405/262; 405/286; 405/284

(58) Field of Classification Search ..... 405/262, 405/284, 285, 286
See application file for complete search history.

(56) References Cited

U.S. PATENT DOCUMENTS

| | | | | |
|---|---|---|---|---|
| 4,824,293 | A * | 4/1989 | Brown et al. | 405/284 |
| 4,914,887 | A * | 4/1990 | Meheen | 405/284 |
| 5,505,563 | A * | 4/1996 | Curt | 405/262 |
| 5,934,838 | A * | 8/1999 | Egan | 405/262 |
| 6,443,663 | B1 * | 9/2002 | Scales et al. | 405/262 |
| 6,447,211 | B1 * | 9/2002 | Scales et al. | 405/262 |
| 6,679,656 | B1 * | 1/2004 | Manthei | 405/284 |
| 7,445,407 | B2 * | 11/2008 | Rainey | 405/262 |
| 7,491,018 | B2 * | 2/2009 | Freitag et al. | 405/262 |
| 7,517,176 | B2 * | 4/2009 | Henderson | 405/262 |
| 2006/0110222 | A1 * | 5/2006 | Price | 405/286 |
| 2007/0009331 | A1 * | 1/2007 | Lee | 405/262 |

* cited by examiner

*Primary Examiner*—Frederick L Lagman

(57) ABSTRACT

A segmental retaining wall system utilizing extruded strips for soil reinforcement. The retaining wall is composed of a plurality of wall blocks that are stacked securely using interlocking pins and an extruded strip. The wall can be built such that it has vertical or battered angle dependant on the orientation of the interlocking pins.

4 Claims, 10 Drawing Sheets

【Fig 1a】
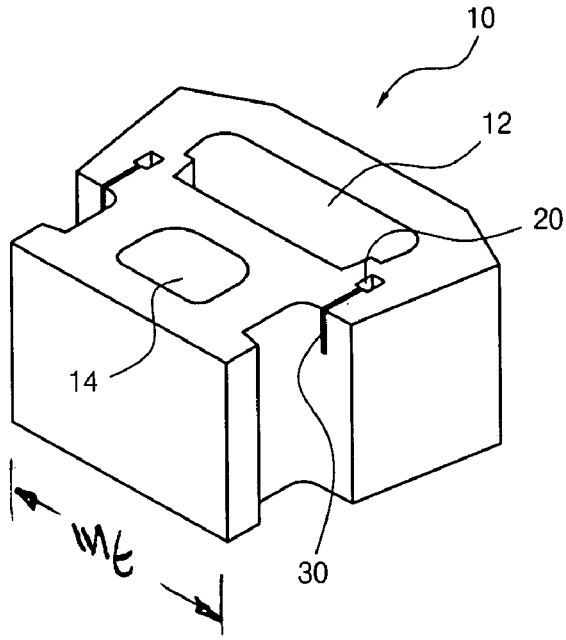
【Fig 1b】
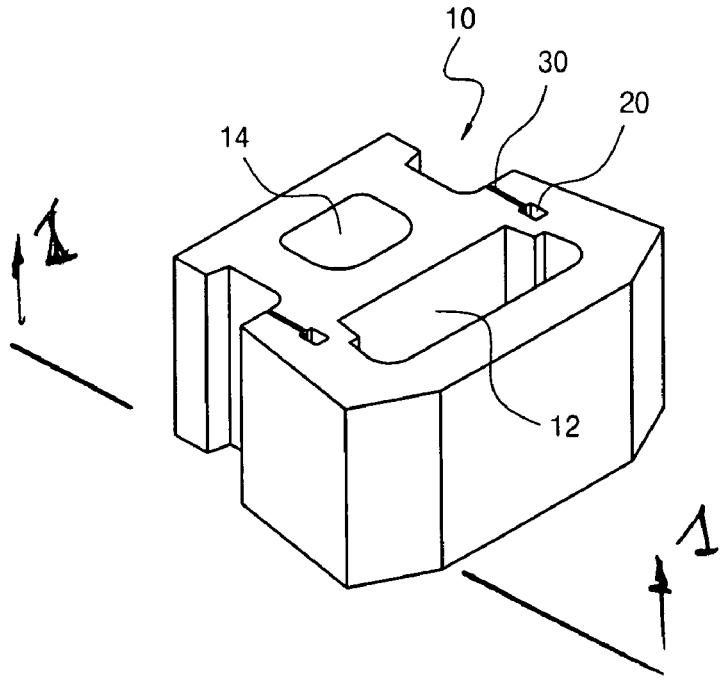

【Fig 1c】
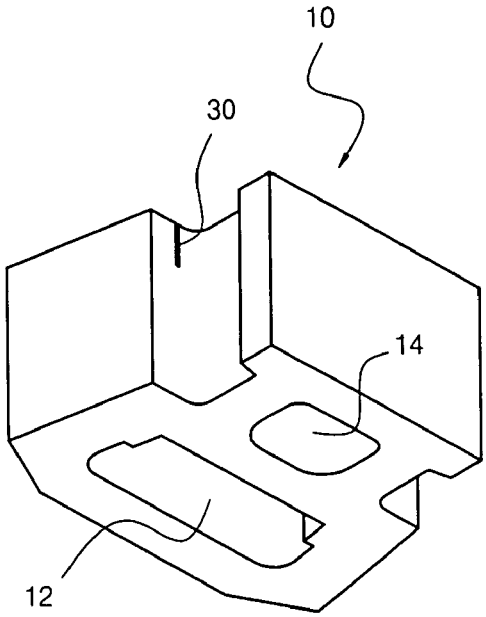
【Fig 2】
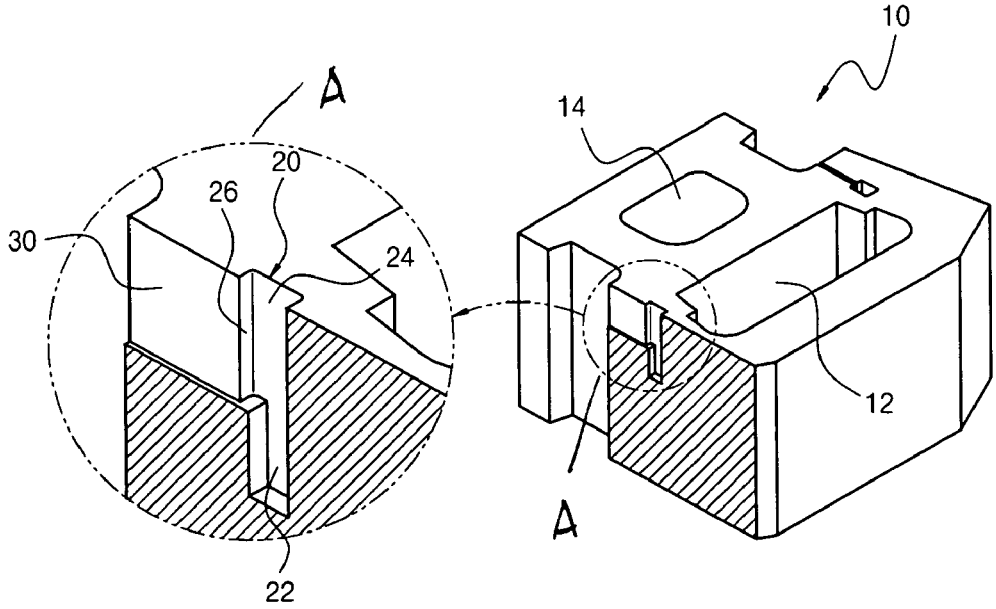

【Fig 3a】
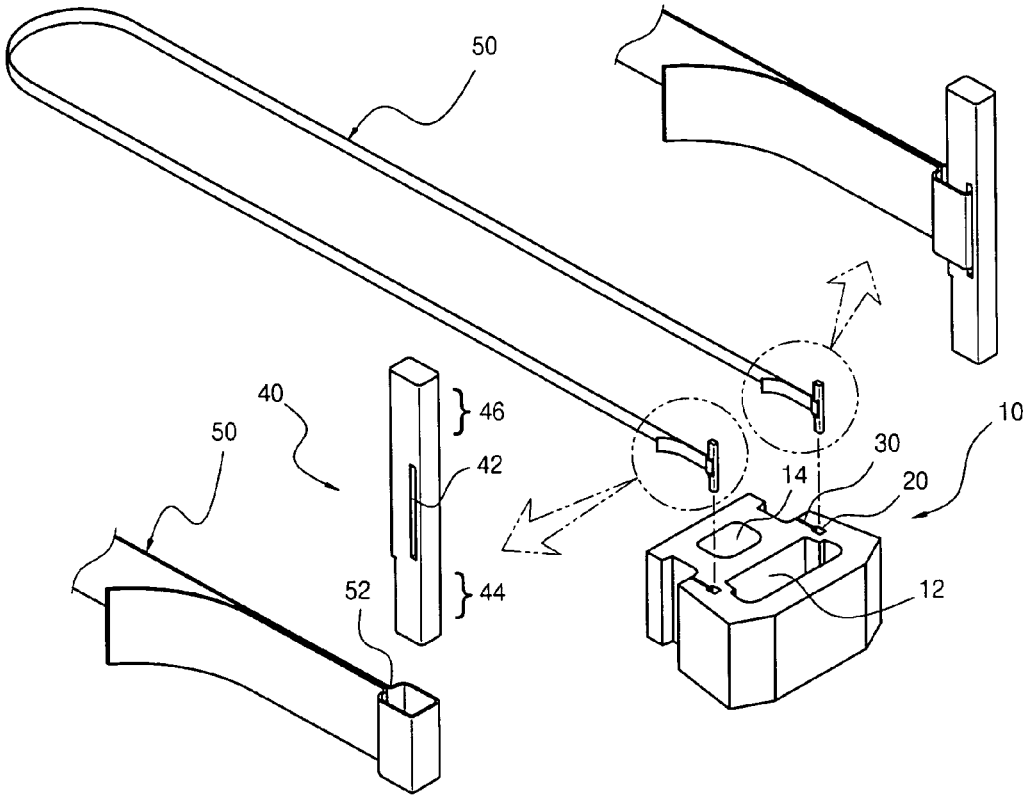

【Fig 3b】
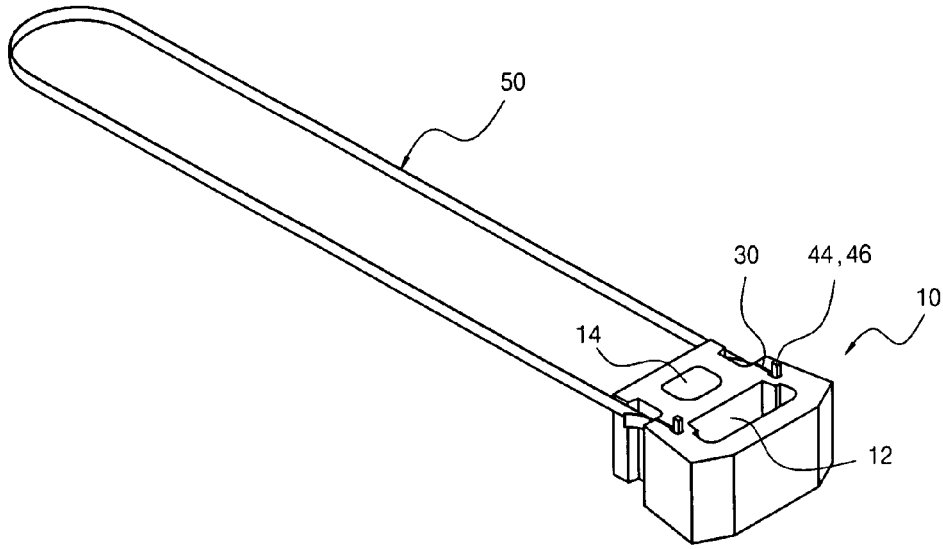
【Fig 4a】
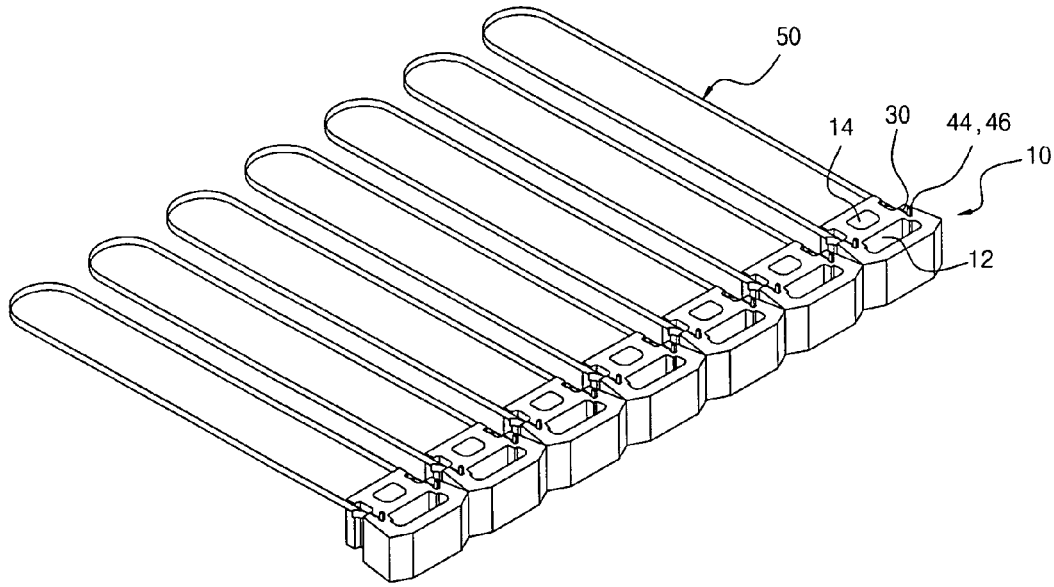

【Fig 4b】
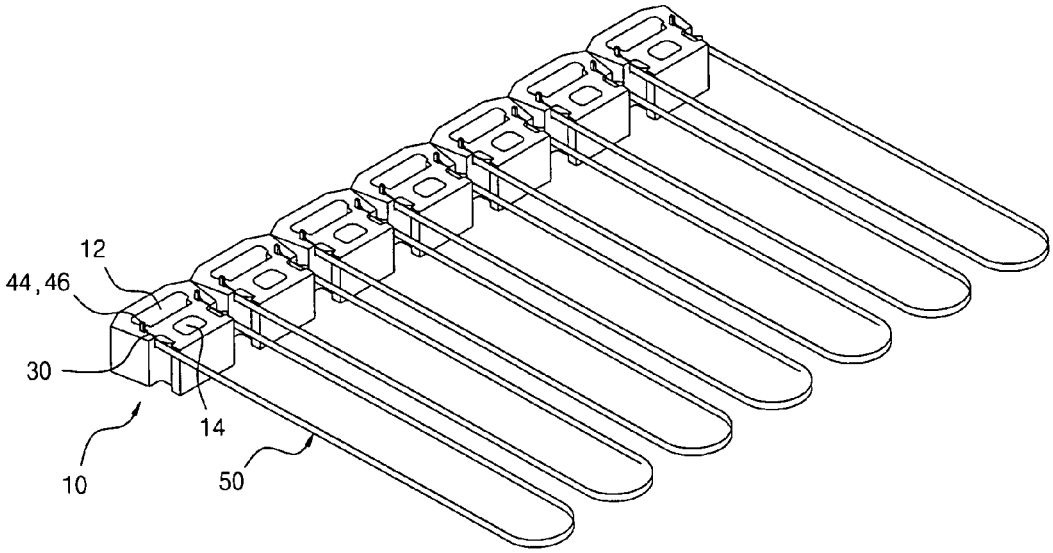

【Fig 5】
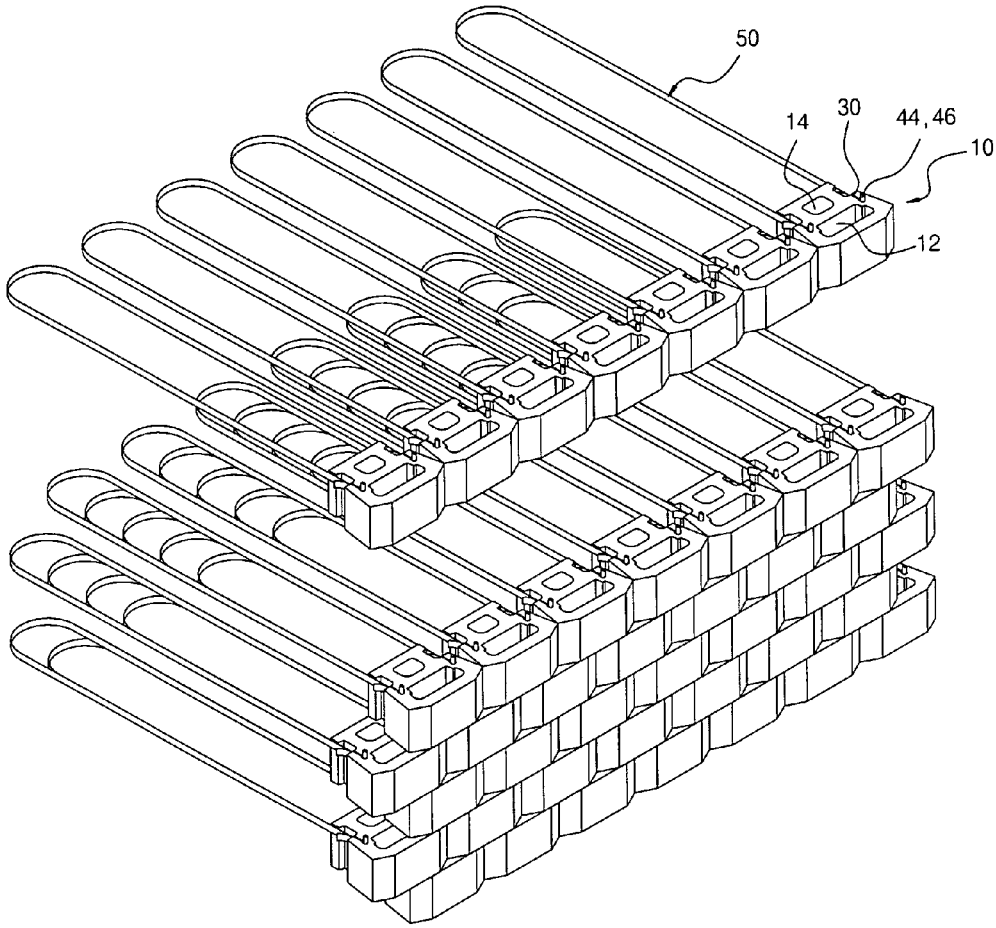

【Fig 6a】
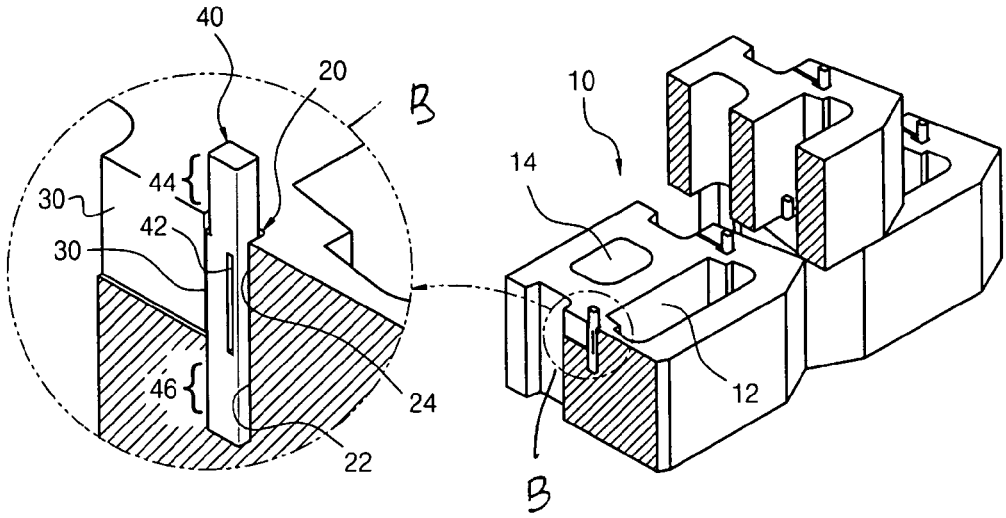
【Fig 6b】
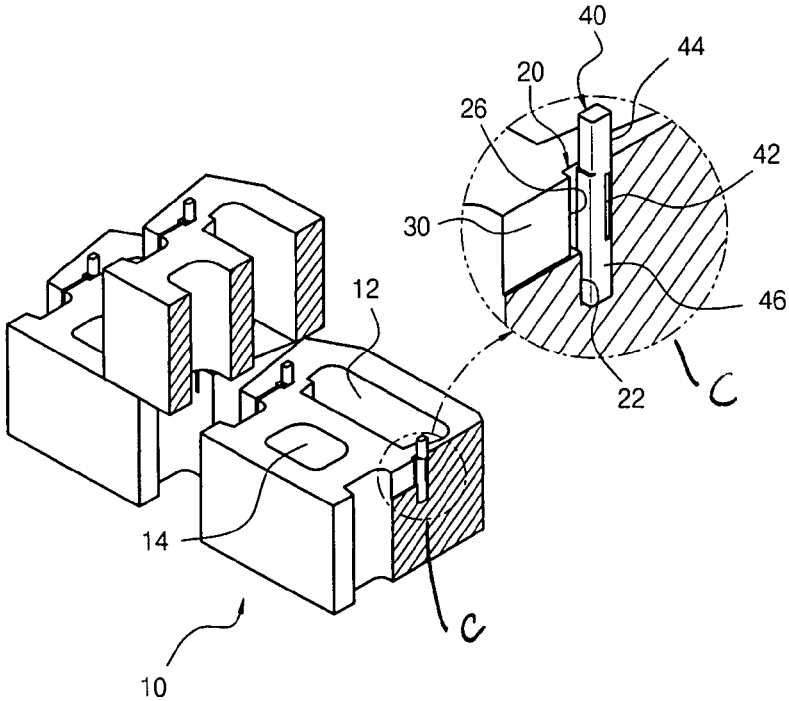

【Fig 6c】
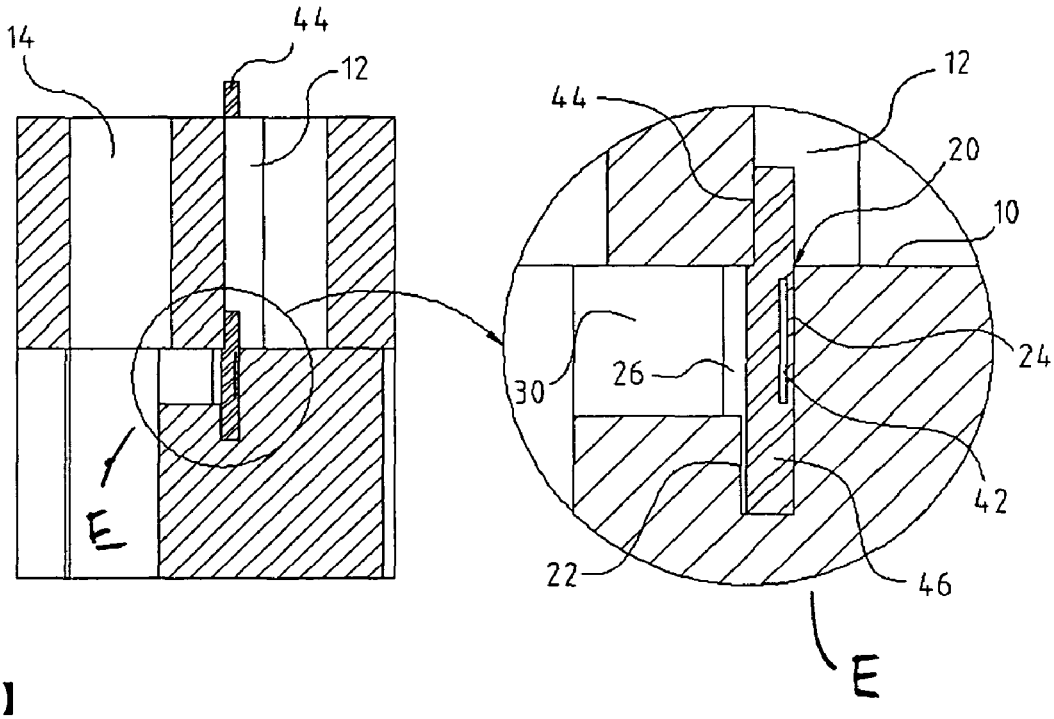
【Fig 6d】
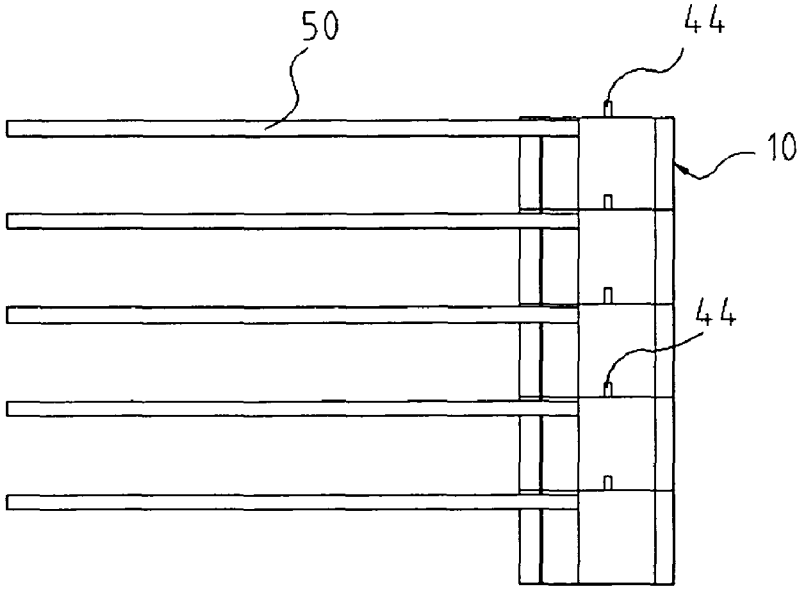

【Fig 7a】
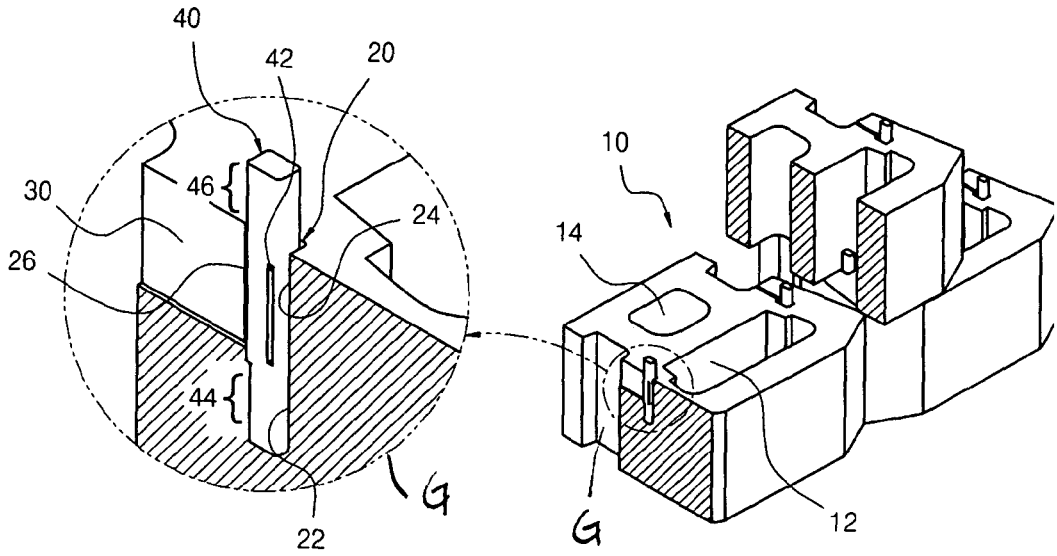
【Fig 7b】
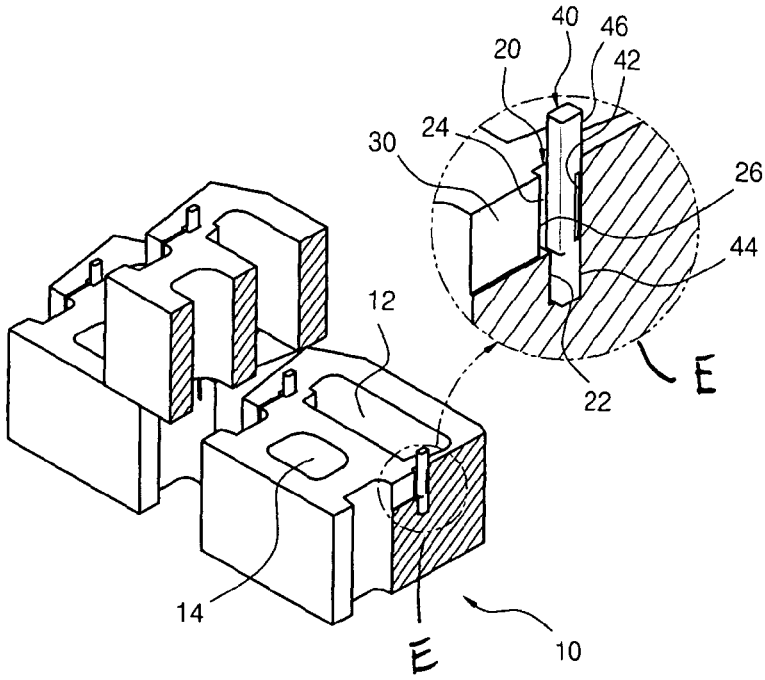

【Fig 7c】
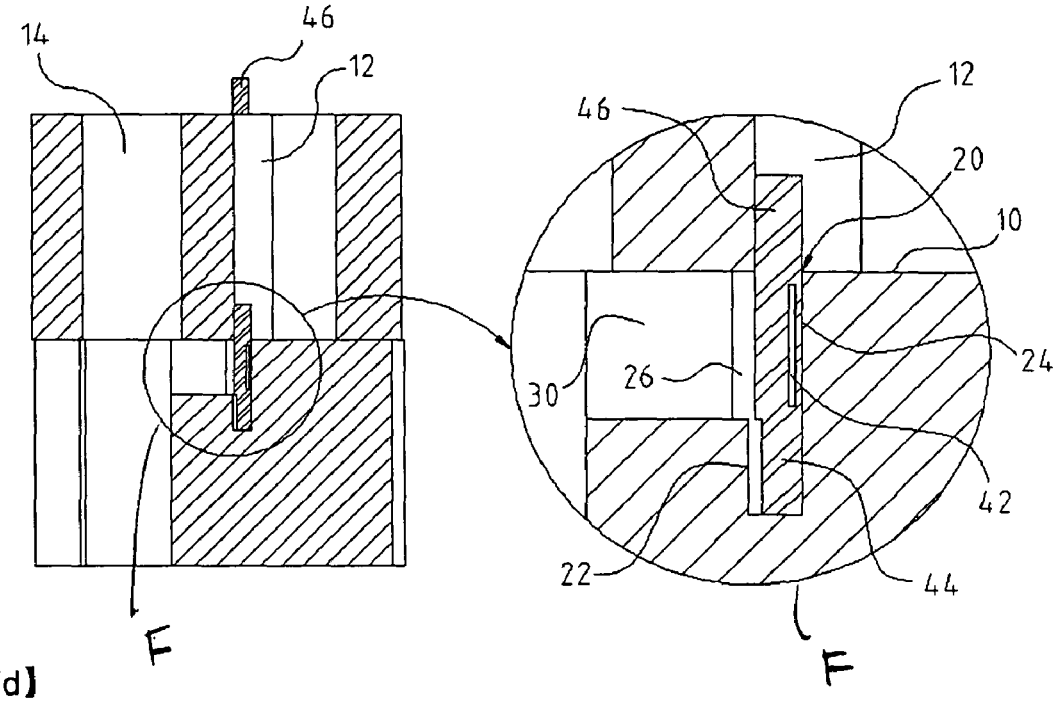
【Fig 7d】
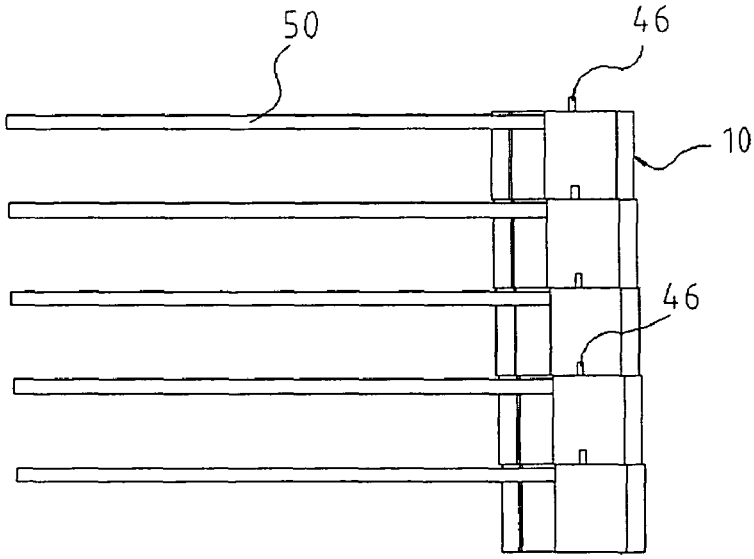

SEGMENTAL RETAINING WALL SYSTEM INCORPORATING THE EXTRUDED POLYMER STRIP AS A REINFORCEMENT

FIELD OF THE INVENTION

The invention relates to a retaining wall system utilizing extruded strips as soil reinforcement. A vertical or battered angle of wall face can be optionally chosen and constructed according to the pin orientation when it is inserted into the pinhole.

DESCRIPTION OF THE PRIOR ART

Segmental retaining walls are generally installed in tandem with a geogrid to retain the backfill and provide a usable area above the retaining wall. Geogrids are commonly made of polymer material and configured in a grid pattern having transverse and longitudinal members. Several manufacturing methods such as weaving, extension after punching, heat welding, laser welding, and ultrasound welding are available to produce them. As a function of the grid pattern they are easy to use and usually exhibit good friction characteristics in the soil. Geogrids are typically installed horizontally from the wall extending backwards into the soil to stabilize the backfill. The limiting factor in the use of geogrids is the strength of its connection to the retaining wall as it has the lowest tensile strength of all contributing parts.

Furthermore, the cost to manufacture the grid pattern product is higher than the extruded polymer strip reinforcement product.

Although the extruded strip is easy to manufacture and cost effective, no segmental retaining wall has provided any satisfactory connection between the block wall and the strip reinforcement.

An example of a segmental retaining wall using strip reinforcement can be found in Korea Patent 10-0660356(2006, Dec. 15). The reinforcement strip in this specific invention is composed of several polyester yarn bundles that are coated with polyethylene. It is folded lengthwise in the middle and is placed on top of the concrete block. However, this style of strip tends to be difficult to hold in place during installation and results in interference between the upper and lower concrete blocks. Thus it slows down the installation procedures which resultantly increase the construction time required. In addition, the overall stability of the retaining wall is limited due to the weak connection between the concrete blocks and reinforcement strip.

SUMMARY OF THE INVENTION

In accordance with the present invention, a segmental retaining wall system that utilizing extruded polymer strips and interlocking pins is provided. The interlocking pins provide a reliable locating mechanism in-between the concrete block layers, and connection between the concrete blocks and the extruded strips, so that it offers the excellent structural stability with cost effectiveness.

Another object of this invention is to use the same pin to create either a vertical or batter angled wall face according to the orientation chosen for the interlocking pin to be inserted into the pinhole.

A clearer understanding of the invention may be had from consideration of the following description and drawing.

BRIEF DESCRIPTION OF THE DRAWINGS

In order that the invention may be more clearly understood, embodiments thereof will now be described in detail by way of example, with reference to the accompanying drawings, in which:

FIG. 1*a* is one perspective view of the concrete block forming part of the segmental retaining wall system.

FIG. 1*b* is another perspective view of the concrete block forming part of the segmental retaining wall system.

FIG. 1*c* is yet another perspective view of the concrete block forming part of the segmental retaining wall system.

FIG. 2 is a section view taken at 1-1 of FIG. 1*b* showing the slot detail together with an enlarged view of the circled portion A.

FIG. 3*a* is an exploded assembly view of the extruded polymer strip in relation to the interlocking pin and concrete block.

FIG. 3*b* is a perspective view of the extruded polymer strip as secured within the concrete block and extending rearwardly therefrom.

FIGS. 4*a* and 4*b* are different perspective views of a single layer of FIG. 3*b* concrete blocks.

FIG. 5 is a perspective view of a multi-layer of FIG. 4*a* or 4*b* concrete blocks.

FIG. 6*a* is a perspective view partly in section of a plurality of stacked blocks together with an enlarged view of the circled portion B.

FIG. 6*b* is a perspective view, partly in section of a plurality of stacked blocks together with an enlarged view of circled portion C.

FIG. 6*c* is a sectional view of two stacked concrete blocks in relationship to the pin 46 together with an enlarged view of circled portion E.

FIG. 6*d* is a sectional view of a plurality of vertically stacked concrete block in relationship to the pin location in FIG. 6*a*, 6*b* or 6*c*.

FIG. 7*a* is a perspective view partly in section of a plurality of stacked blocks together with an enlarged view of the circled portion G.

FIG. 7*b* is a perspective view, partly in section of a plurality of stacked blocks together with an enlarged view of circled portion F.

FIG. 7*c* is a sectional view of two stacked concrete blocks in relationship to the pin 46 together with an enlarged view of circled portion E.

FIG. 7*d* is a sectional view of a plurality of vertically stacked concrete block in relationship to the pin location in FIG. 7*a*, 7*b* or 7*c*.

DESCRIPTION

The present invention relates to a retaining wall system that is composed of concrete blocks, interlocking pins and extruded strips. The retaining wall can be optionally built as a vertical wall or a batter wall.

The preferred embodiment of the invention comprises concrete blocks having front and rear internal cavity openings 12 and 14, vertically formed pin-holes 20 adjacent to the rear corners of the front cavity opening, and polymer strip accommodating channels 30 opening to the rear of the concrete block. A bar shaped interlocking pin 40 has slot 42 in its central portion to allow for the polymer strip to be inserted and doubled back upon itself for retention therein when the pin 40 is inserted into the pin hole 20.

When the concrete blocks are installed in stacked layers the interlocking pin protrudes above the surface of each concrete block and abuts the rear surface of the front cavity opening of the overlaying concrete block to thereby locate it. The direction of insertion of the interlocking pin into the pin-hole defines either a vertical or batter wall.

The preferred embodiment of the segmental retaining wall system utilizes polymer extruded strips as soil reinforcement. A plurality of concrete blocks 10 are stacked and located by means of the interlocking pins 40 and extruded strips 50 in either a vertical or battered angled retaining wall defined by the orientation direction of the interlocking pin 40 in the pinhole 20.

In the preferred embodiment of the invention the front to back depth of one end (second pin-end) of the interlocking pin is same as the depth of the middle portion of the pin while the depth of the other end (first pin-end) of the interlocking pin is smaller than the depth of the middle portion of the interlocking pin. The width wt of the concrete block tail is no greater than the distance between the strip accommodating channels of the concrete block so as not to interfere with the rearward extension of the extruded strips.

In another preferred embodiment, when the concrete blocks are installed in layers, the rear side of the interlocking pin protruding above the top surface of the concrete block contacts directly to the rear surface of the front opening of the overlaying concrete block.

As illustrated in FIGS. 1*a*, 1*b*, and 1*c*, the concrete blocks 10 have a front cavity opening 12 and a rear cavity opening 14 which are designed to be filled with aggregate during installation to provide support and stability to the wall. The pinholes 20 are formed vertically downwards to a certain depth from the top surface of the concrete block 10 adjacent to the rear edge corners of the front cavity opening 12.

As shown in FIG. 2, the pinholes comprise an internal pinhole portion 22 into which the first or second pin end of the interlocking pin 40 may be optionally. The external pinhole portion 24 is aligned with the middle portion of the interlocking pin 40 to accommodate the strip. The external pinhole 24 is located immediately above the internal pinhole 22 and is slightly wider to allow for the thickness of the doubled portion of the strip as will be described.

The strip-accommodating channel 30 is narrower than the width of the pinhole 24 and extends from the rear of the pinhole and opens at the rear of the concrete block 10. The depth of the channel 30 is dimensioned to be larger than the width of the strip 50.

Preferably, the width wt of the concrete block tail is less than the distance between the strip accommodating channels 30 of the concrete block 10 so that the extruded strip 50 can be installed without any interference from the tail portion of the concrete block 10.

The bar shaped interlocking pin 40 is inserted into the pinhole 20 of the concrete block 10. As illustrated in FIGS. 3*a* and 3*b*, the interlocking pin 40 has a slot 42 in its central portion for attachment of the strip. In more detail, the depth of the first pin-end 44 of the interlocking pin 40 is smaller than the depth of the middle portion of the interlocking pin 40 and the depth of the second pin-end 46 of the interlocking pin 40 equal to the depth of the middle portion of the interlocking pin 40.

As depicted in FIGS. 3*a* and 3*b*, when the interlocking pin 40 is inserted into pinhole 20, the first pin-end 44 or the second pin-end 46 may optionally be inserted into the internal pinhole 22. In all cases the central or middle portion of the interlocking pin 40 is located and aligned with the external pinhole 24. As illustrated in FIG. 6, the rear surface of the first pin-end 44 of the interlocking pin 40 locates the rear surface of the front opening 12 of overlaying concrete block 10 allowing for the construction of a vertical wall.

Alternatively, when the rear surface of the second pin-end 46 of the interlocking pin locates the rear surface of the front opening 12 of upper concrete block, a setback or batter angle as a function of the depth difference between the first and second pin-end of the interlocking pin will occur.

For assembly, the extruded strip 50 is inserted through the slot 42 of the interlocking pin 40, doubled back upon itself and inserted along the strip accommodating channel 30 and extending rearwards. The strip 50 is preferably a polymer strip manufactured by the process of extrusion.

Since the interlocking pin 40 and the strip 50 are inserted together into the pinhole 20 of the concrete block 10, the pinhole 20 must be wider than the dimension of the interlocking pin 40 in order to accommodate the thickness of the two overlapping strips 50. However, if the pinhole 20 is too wide, the interlocking pin 40 can be pulled out and dislocated easily making it difficult to install the retaining wall with some acceptable precision. It is for this reason that pinhole 20 is preferably divided in two portions such as the internal pinhole 22 and the external pinhole 24. Thus, the interlocking pin 40 is inserted into the internal pinhole 22 located below the external pinhole 24 and securely retained therein.

The configured pinhole enhances the accuracy of installation and reduce the construction time required. As the end portion of the interlocking pin 40 is inserted into the internal pinhole 22 that is located lower than the strip-merging hole 26 or accommodating channel 30, unnecessary force is not exerted on the back surface of the strip-merging hole 26.

As illustrated in FIG. 4*a*, 4*b*, and FIG. 5, the concrete blocks 10 are placed together side by side, and stacked in layers to build the segmental retaining wall which can be built vertically or angled backwards as the height increases. Either vertical or a setback can optionally be chosen.

FIG. 6*a*, 6*b*, 6*c*, and 6*d* depict the vertical installation of the concrete blocks 10. In this configuration the interlocking pin 40 is inserted into pinhole 20 such that the second pin-end 46 is positioned downward. Thus the second pin-end 46 will be inserted into the internal pinhole 22 and the middle portion of the interlocking pin 40 will be located within the external pinhole 24. The first pin end 44 will therefore protrude above the top surface of the concrete block 10. As previously described, the depth of the first pin-end 44 is smaller than that of the second pin-end 46.

When concrete blocks 10 are installed in layers the rear surface of the first pin-end 44 of the interlocking pin 40 contacts the rear surface of the front opening 22 of overlaying concrete block defining its location. With repetition, a vertical retaining wall will be constructed.

As the extruded strip 50 passes through the slot 42 of the interlocking pin 40, there is no other material present between the front of the interlocking pin 40 and the inner surface of the pinhole 20. Therefore there is no variation in setback or wall batter with or without the strip 50 installation. There is no variation in setback or wall batter with or without the strip 50 installation because there is no other material present between the interlocking pin 40 and the inner surface of the pinhole 20 due to the slot 42 through which the strip passes.

FIGS. 7*a*, 7*b*, 7*c*, and 7*d* depict the installation of the concrete blocks 10 with a wall batter. In this configuration, the interlocking pin 40 is inserted into pinhole 20 such that the first pin end 44 is oriented downward, thus the middle portion of the interlocking pin 40 will be located inside of the external pinhole 24. The second pin end 46 will therefore protrude above the top surface of the concrete block 10.

When the concrete blocks 10 are installed in layers the rear surface of the second pin-end 46 of the interlocking pin 40 contacts the rear surface of the front opening 22 of overlaying concrete block 10. With repetition, a retaining wall having a battered angle will be constructed. The setback is equivalent to the depth difference between the first pin-end 44 and the second pin-end 46.

A vertical or battered angle of wall face can be optionally chosen and constructed according to which end of the interlocking pin 40 is inserted into the internal pinhole 22.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A concrete block for use in a segmental retaining wall in combination with an extruded strip and a bar-shaped interlocking pin having a depth and length;

said concrete block having a front face and comprising a top surface and a bottom surface; a front portion having a width, rear faces and a top to bottom opening therethrough, said opening having an inner backside surface; a tail portion having a width integral with said front portion; pinholes having a width extending downwardly to a depth from the top surface of the front portion adjacent said rear faces; strip accommodating channels between said vertical pinholes and rear faces having a width narrower than the width of the pinholes said bar-shaped interlocking pin having a length greater than the depth of the pinhole and a vertically elongated slot opening for receiving the extruded strip in wrapped fashion wherein said pin and extruded strip is optionally insertable into said pinhole and strip accommodating channel by way of either the first pin end or the second pin end and retained therein and wherein the depth of the first pin-end of the interlocking pin is narrower than the depth of the middle portion of the interlocking pin, and the depth of the second pin-end of the interlocking pin is the same as the depth of the middle portion of the interlocking pin.

2. The concrete block of claim 1, wherein the width of the pinhole adjacent the wrapped extruded strip is greater than the width of the middle portion of the interlocking pin to thereby accommodate the wrapped extruded strip therein.

3. The concrete block of claim 2 wherein the rear surface of the first pin-end of the interlocking pin protruding above the top surface thereof is in alignment contact with the inner backside surface of the front opening of an overlying concrete block of claim 1 whereby the front faces of the concrete blocks are in vertical alignment.

4. The concrete block of claim 2 wherein the rear surface of the second pin-end of the interlocking pin protruding above the top surface thereof is in alignment contact with the inner backside surface of the front opening of an overlying concrete block of claim 1 whereby the front faces of the overlying concrete block is setback from the front face of the underlying block equivalent to the depth difference between the first pin-end and the second pin-end.

* * * * *